United States Patent [19]

Shingyouchi

[11] 4,103,774

[45] Aug. 1, 1978

[54] CAPSULE

[76] Inventor: Fusao Shingyouchi, 39-9, Moto-yoyogi, Shibuya-ku, Tokyo, Japan

[21] Appl. No.: 756,123

[22] Filed: Jan. 3, 1977

[30] Foreign Application Priority Data

Jan. 14, 1976 [JP] Japan ..... 51-3150[U]
Mar. 15, 1976 [JP] Japan ..... 51-30765[U]

[51] Int. Cl.[2] ..... B65D 5/52; B65D 25/24

[52] U.S. Cl. ..... 206/45.2; 46/11; 46/25; 206/216; 211/14; 215/99.5; 220/4 B; 220/23.4; 248/346

[58] Field of Search ..... 46/2, 11, 25, 26; 211/14; 215/10, 99.5; 220/4 B, 4 E, 23.4; 206/45.2, 216, 504, 521, 0.81; 248/346, 346.1

[56] References Cited

U.S. PATENT DOCUMENTS

| | | | |
|---|---|---|---|
| 1,505,132 | 8/1924 | Delich | 211/14 |
| 1,921,015 | 8/1933 | Young | 220/4 E |
| 2,858,955 | 11/1958 | Kroenert | 220/4 B |
| 2,899,097 | 8/1959 | Haskins | 220/4 E |
| 2,916,850 | 12/1959 | Vlachos | 46/2 |
| 2,975,547 | 3/1961 | Greve | 46/11 |
| 2,975,930 | 3/1961 | Pennington et al. | 220/23.4 |
| 2,996,208 | 8/1961 | Schroeder | 215/99.5 |
| 3,374,917 | 3/1968 | Troy | 215/10 |
| 3,611,621 | 10/1971 | Folson | 46/25 |
| 3,822,499 | 7/1974 | DeVos | 46/26 |
| 3,983,658 | 10/1976 | de Sanz | 46/11 |
| 3,998,003 | 12/1976 | Rosenbaum | 46/26 |

FOREIGN PATENT DOCUMENTS

| | | | |
|---|---|---|---|
| 160,861 | 8/1953 | Australia | 215/99.5 |
| 2,115,693 | 10/1972 | Fed. Rep. of Germany | 206/504 |
| 101,116 | 11/1961 | Netherlands | 46/26 |

*Primary Examiner*—William Price
*Assistant Examiner*—Bruce H. Bernstein
*Attorney, Agent, or Firm*—McDougall, Hersh & Scott

[57] ABSTRACT

A capsule for containing a commodity, sold by a slot machine, includes a main body having a holding portion for holding a commodity; a cover member for covering an opening of the holding portion, demountable from the main body; and a combining means formed on at least one of the main body and the cover member, for combining the main body with the cover member in such a condition that the opening of the holding portion is not covered with the cover member, or for combining a plurality of the capsules with each other. After the commodity is taken out from the capsule, the capsule can be utilized as a toy or an element of a toy.

4 Claims, 15 Drawing Figures

CAPSULE

BACKGROUND OF THE INVENTION

1. Field of the Invention

This invention relates to a capsule for containing a commodity, and more particularly to a capsule containing a commodity for sale by a slot machine.

2. Description of the Prior Art

A slot machine for toys is widely used. When a coin is inserted into a slot of the slot machine, a capsule containing a toy is ejected from the slot machine at random. Capsules received by the slot machine contain different toys, respectively. What toy can be obtained from the slot machine, cannot be previously known. For that reason, children is very interested in the slot machine for toys, and so sales of toys increases.

All of the capsules received by the slot machine have the same shape and size, since the capsule should be one by one ejected without trouble. After the toy is taken out from the capsule, the capsule is useless and rubbish. Generally, the capsules are formed of synthetic resin, and so cause public nuisances of scrapped material.

SUMMARY OF THE INVENTION

An object of this invention is to provide a capsule which can be utilized for some purposes after the toy is taken out from the capsule, to prevnet the public nuisance of scrapped material and to effectively use natural resources.

Another object of this invention is to provide a capsule which can be utilized as a savings box or an egg stand, after the toy is taken out from the capsule.

A further object of this invention is to provide a capsule which can be utilized to construct a toy.

A still further object of this invention is to provide a capsule for which a mold is simple, and which can be easily and inexpensively manufactured.

In accorance with an aspect of this invention, a capsule for containing a commodity, sold by a slot machine, includes a main body having a holding portion for holding a commodity; a cover member for covering an opening of the holding portion, demountable from the main body; and a combining means formed on at least one of the main body and the cover member, for combining the main body with the cover member in such a condition that the opening of the holding portion is not covered with the cover member, or for combining a plurality of the capsules with each other.

The above and other objects, features and advantages of this invention will become apparent from the following detailed description of illustrative embodiments shown in the accompanying drawings.

DESCRIPTION OF THE PREFERRED EMBODIMENTS

Figure 1:
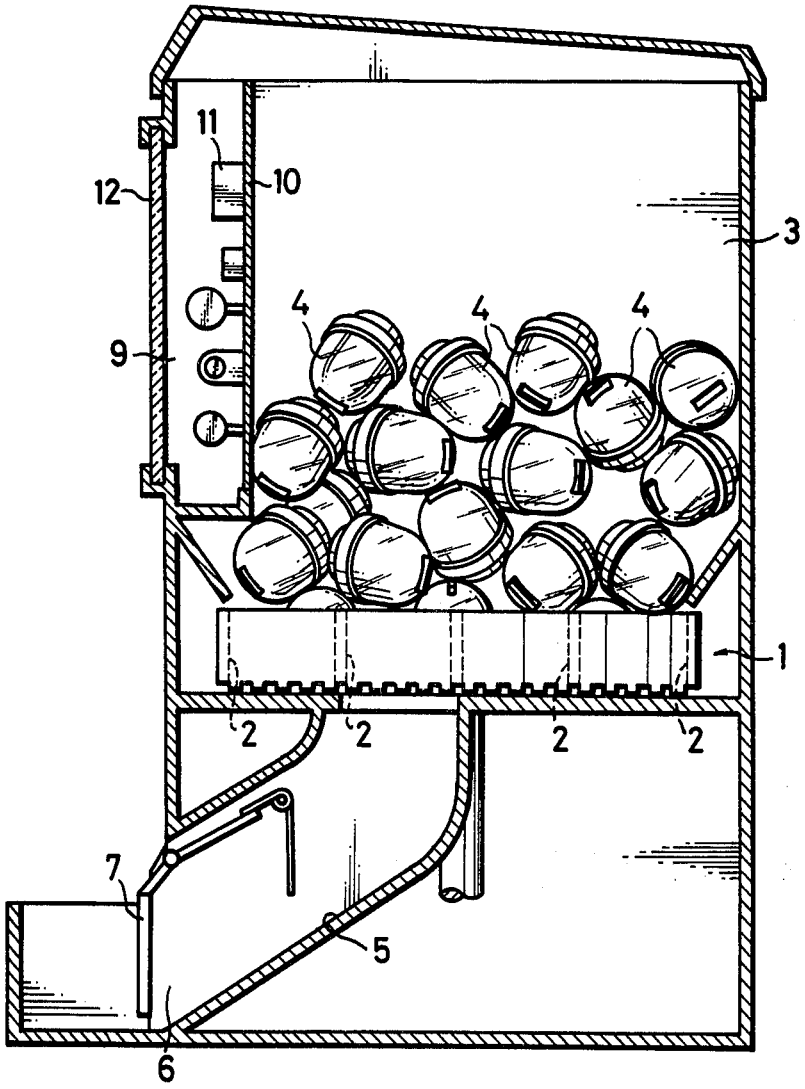
FIG. 1 is a cross-sectional view of a slot machine used for capsule according to this invention.

First, an outline of a slot machine for toys will be described in reference to FIG. 1. This slot machine is shaped substantially in a rectangular parallelepiped. Within a cabinet of this slot machine, a rotary disc 1 is rotatably arranged. This rotary disc 1 has a plenty of compartments 2 along the circumference of this disc 1. A chamber 3 is formed above the rotary disc 1. In this chamber 3, are stored many capsules 4, wherein many kinds of toys are held respectively.

The capsule 4 has such a size that the capsule 4 can be received in the respective compartment 2 of the rotary disc 1. Therefore, one of the capsules 4 in the chamber 3 falls into the compartment 2 at random.

When a predetermined coin is inserted into the slot of the machine, the rotary disc 1 rotates by a predetermined angle, and the capsule 4 received in the compartment 2 above a feed chute 5 falls into the feed chute 5. Accordingly, the capsule 4 can be taken out by opening of a lid 7 of a discharge opening 6.

At the front side of the chamber 3, is provided a sample displaying chamber 9. This sample displaying chamber 9 is separated from the chamber 3 by a shield plate 10. On the front surface of the shield plate 10, many kinds of samples of commodities 11 or the toys are displayed, and these samples are taken out of the capsules 4. These goods 11 can be observed from outside through a transparent plate 12 provided at the front side of the slot machine.

Next, will be described a capsule according to the first embodiment of this invention. This capsule is suitable for the above discribed slot machine.

Figure 2:
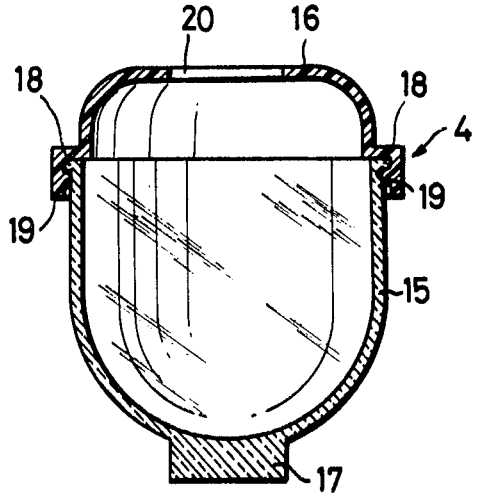
FIG. 2 is a cross-sectional view of a capsule according to the first embodiment of this invention.
Figure 3:
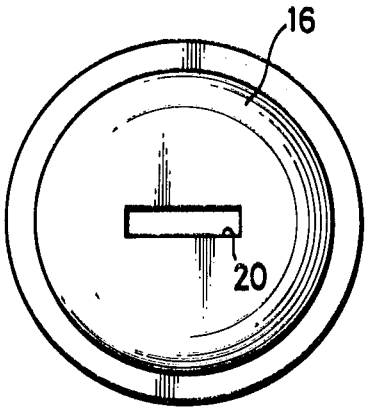
FIG. 3 is a plan view of the capsule of FIG. 2.
Figure 4:
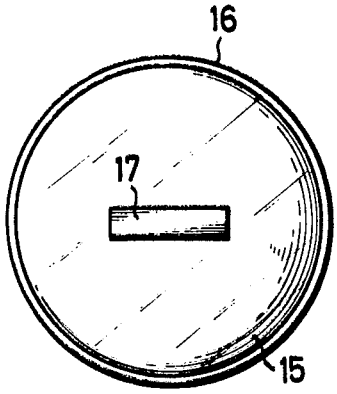
FIG. 4 is a bottom view of the capsule of FIG. 2.

As shown in FIG. 2, FIG. 3 and FIG. 4, this capsule 4 comprises a main body 15 and a cover 16. The main body 15 is made of transparent styrene resin, and has a shape of substantially a hemisphere. A ridge 17 is formed integrally with the bottom of the main body 15. Further, this main body 15 has an opening, and through this opening, the commodity or the toy is received within the capsule 4. An annular projection 18 is formed at the outside of the upper edge of the main body 15.

On the other hand, the cover 16 is made of polyvinylchloride resin and is shaped flatly. An annular groove 19 is formed at the inside of the edge of the cover 16. The opening of the main body 15 is closed by the cover 16 in such a manner that the cover 16 is deformed and the annular groove 19 of the cover 16 is fitted to the annular projection 18 of the main body 15. The cover 16 further defines a slit 20 substantially at the center of the cover 16.

Above described capsules 4 which hold respective toys are stored in the chamber 3 of the slot machine in FIG. 1. When a coin is inserted into the slot, this slot machine feeds a commodity or a toy which is enclosed by the capsule 4. Therefore, one can take the commodity out of the capsule 4 by removing the cover 16.

After taking the commodity out of the capsule 4, when the opening of the main body 15 is again closed by the cover 16, this capsule 4 can be utilized as a savings box. That is, the slit 20 of the cover 16 has such a size that a coin can pass therethrough. Therefore, coins can be one by one fallen into the capsule 4 and can be stored in this capsule 4.

Figure 5:
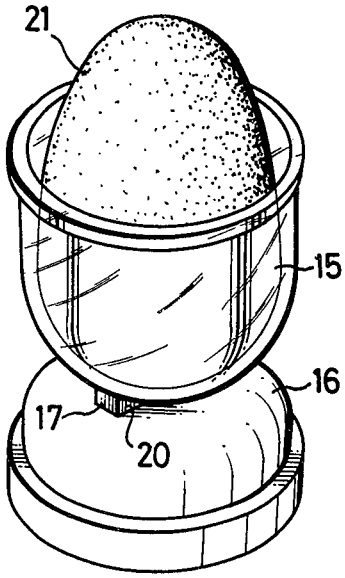
FIG. 5 is a perspective view of the capsule of FIG. 2, utilized as an egg stand.

Further, after removing the cover 16 from the main body 15, when the ridge 17 of the main body 15 is fitted into the slit 20 of the cover 16, this capsule 4 can be utilized as an egg stand. That is, a hard boild egg 21 can be held within the main body 15 as shown in FIG. 5.

Figure 6:
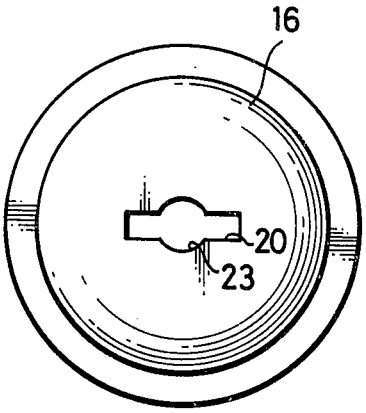
FIG. 6 is a plan view of a capsule according to the second embodiment of this invention.
Figure 7:
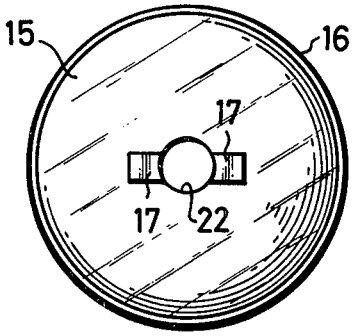
FIG. 7 is a bottom view of the capsule of FIG. 6.

Next, the second embodiment of this invention will be described in reference to FIG. 6 and FIG. 7. This embodiment is obtained by giving some modifications on the capsule 4 according to the first embodiment of this invention.

That is, round openings 22 and 23 are further defined at the center of the main body 15 and the cover 16 respectively. Accordingly, the capsule 4 can be used for further purpose. Namely, the opening of the main body 15 is closed by the cover 16 after taking out the commodity, and the round openings 22 and 23 are penetrated by a shaft which is supported by a box. Thus, a toy of a freight car will be constructed. The round opening 22 and 23 don't need to be previously formed in the main body 15 and the cover 16. Namely, corresponding to the openings 22 and 23, small discs are integrally formed with the main body 15 and the cover 16 respectively through annular thinned portions. Then, the openings 22 and 23 can be formed by pushing out the small discs.

Figure 8:
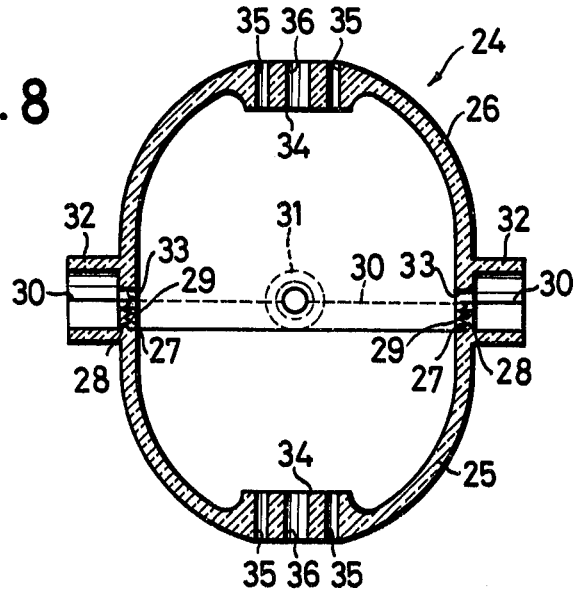
FIG. 8 is a corss-sectional view of a capsule according to the third embodiment of this invention.
Figure 9:
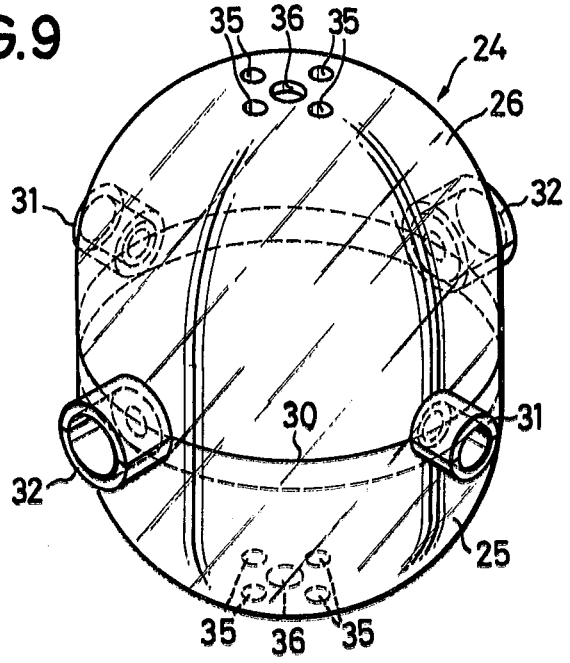
FIG. 9 is a perspective view of the capsule of FIG. 8.

Next, will be described a capsule according to the third embodiment of this invention. As shown in FIG. 8 and FIG. 9, this capsule 24 comprises a main body 25 and a cover 26. The main body 25 and the cover 26 have both the same shape substantially of a hemisphere and both are made of synthetic resin. A male screw 28 is formed on the outside of an annular projection 27 defined on the opening edge of the cover 26. This male screw 28 is engaged with a female screw 29 which is formed at the opening edge of the main body 25, and the opening of the main body 25 and the opening of the cover 26 are closed with each other.

Further, four cylindrical projections 31 and 32 are formed at an abutment 30 of the main body 25 and the cover 26 at the angular intervals of 90 degrees. A pair of the cylindrical projections 31 is smaller, and the other pair of the cylindrical projections 32 is larger. Still more, the inner diameters of the projections 32 are nearly equal to the outer diameters of the projections 31. Accordingly, the capsules 24 are connected with each other in the lateral direction in such a manner that the smaller projection 31 of the one capsule 24 is inserted into the larger projection 32 of the other capsule 24. Further, since axes of the cylindrical projections 31 and 32 cross the abutment 30 of the main body 25 and the cover 26, that is, the upper half and lower half of the cylindrical projections 31 and 32 are flush with the abutment 30, as shown in FIG. 9, the metal molds can be easily taken away when the main body 25 and the cover 26 have been molded in the manufacturing. Therefore, the main body 25 and the cover 26 are easily formed. At the centers of the cylindrical projections 31 and 32, round openings 33 are formed. The shaft penetrates these openings 33 to give multiplicity of the use of the capsule 24, and to reinforce the toys which are constructed by the capsules 24.

Round projections 34 are formed integrally with the bottom of the main body 25 and with the top of the cover 26. These round projections 34 define four small holes 35 and a central hole 36. The small holes 35 are fitted with the pins of a joint, which will be described below, to connect the capsules 24 with each other upward and downward. The central holes 36 are penetrated with a shaft, in the same manner as the round openings 33, to give multiplicity of the use of the capsule 24 and to reinforce the toys which are constructed by the capsules 24.

Figure 10:
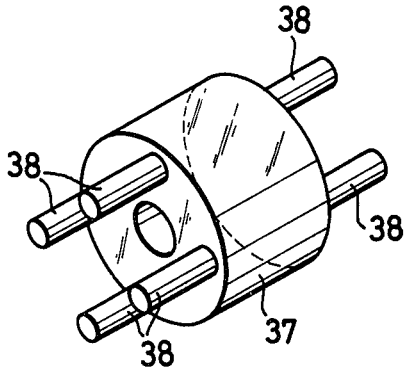
FIG. 10 is a perspective view of a joint for jointing two of the capsules of FIG. 8.

Next, will be described a joint 37 which is used for connecting upward and downward the capsules 24 to construct toys by plural capsules 24. This joint 37 is formed cylindrically as shown in FIG. 10, and at the both ends of this joint 37, four pins 38 are formed respectively. These pins 38 are engageable with the small holes 35 defined at the round projection 34 of the capsule 24. Further, the hollow portion of this joint 37 can be penetrated with a shaft. This joint 37 is held in the capsule 24 together with the toys, and sold by the slot machine. Therefore, one needs not buy the joint in other way.

Figure 11:
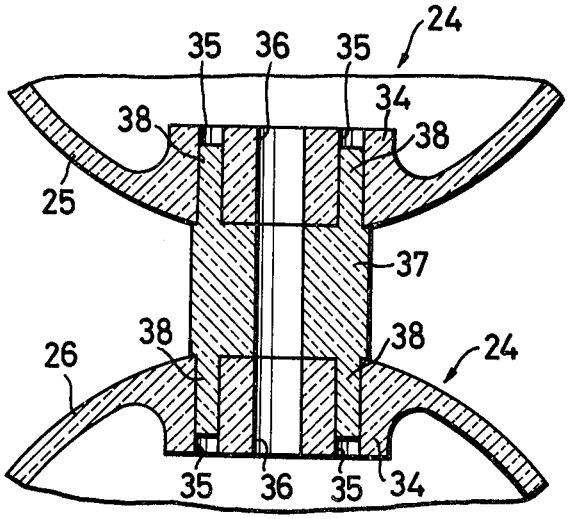
FIG. 11 is an enlarged cross-sectional view of an important part of the capsules of FIG. 8, jointed upward and downward.
Figure 12:
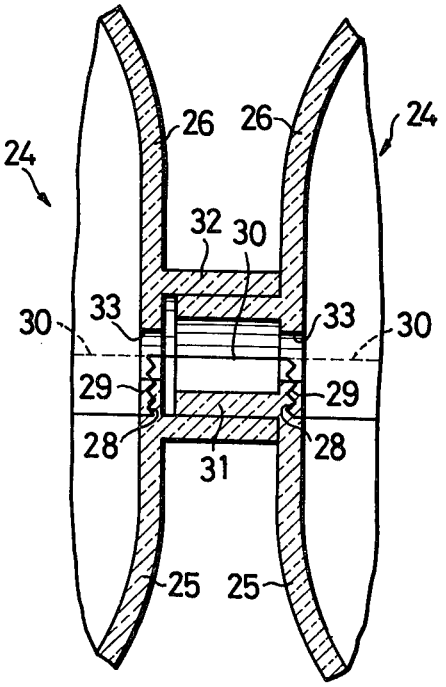
FIG. 12 is an enlarged cross-sectional view of an important part of the capsule of FIG. 8, jointed transversely.

Next, the method of the connecting of the capsule 24 to form toys will be described in reference to FIG. 11 and FIG. 12. When the capsules 24 are connected with each other upward and downward, the small holes 35 of the cover 26 of the lower capsule 24 are engaged with the pins 38 defined at the lower end of the joint 37, and the small holes 35 of the main body 25 of the upper capsule 24 are engaged with the pins 38 defined at the upper end of the joint 37, as shown in FIG. 11. When the capsules 24 are connected with each other in the lateral direction, the cylindrical projection 31 and the cylindrical projection 32 are fitted with each other as shown in FIG. 12. Since the outer diameter of the cylindrical projection 31 is nearly equal to the inner diameter of the cylindrical projection 32, as described above, these projections 31 and 32 are easily fitted with each other. Thus, many capsules 24 can be connected with each other in every direction. By varying the way of the connection of the capsule 24, will be constructed different toys as a light-house, a space station and an observatory and so on.

Figure 13:
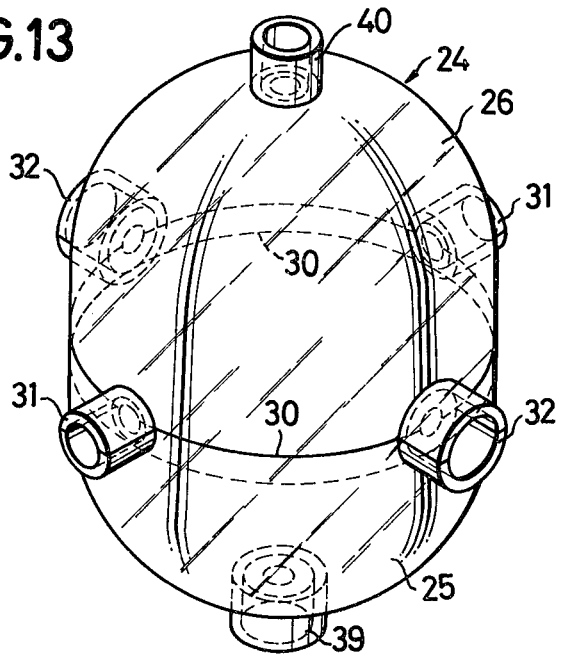
FIG. 13 is a perspective view of a capsule according to the fourth embodiment of this invention.

Next, the fourth embodiment of this invention will be described in reference to FIG. 13. In this embodiment, some modifications are added to the capsule 24 according to the third embodiment of this invention.

That is, instead of the small holes 35, cylindrical projections 39 and 40 are defined at the bottom of the main body 25 and at the top of the cover 26, respectively. Further, inner diameter of the cylindrical projection 39 is nearly equal to the outer diameter of the cylindrical projection 40. Accordingly, the capsules 24 can be connected with each other upward and downward through these cylindrical projections 39 and 40.

Next, the fifth embodiment of this invention will be described in reference to FIG. 14. In this embodiment, other modifications are added to the capsule 24 according to the third embodiment of this invention.

Figure 14:
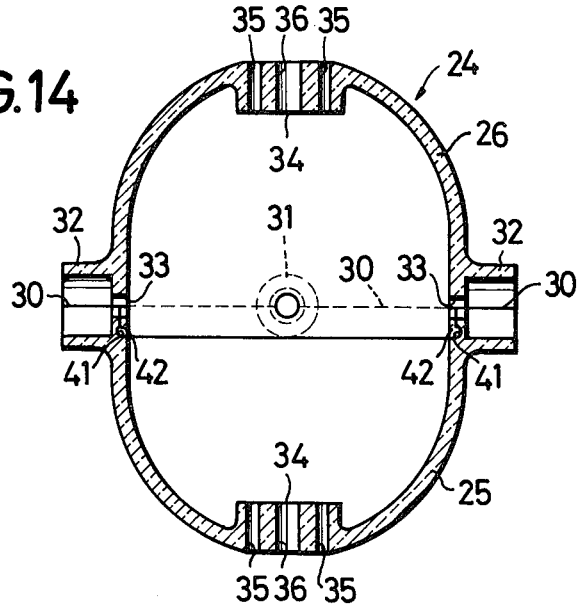
FIG. 14 is a cross-sectional view of a capsule according to the fifth embodiment of this invention.

That is, instead of the male screw 28 and the female screw 29, an annular groove 41 is formed on the alutment 30 of the main body 25, and an annular projection 42 is formed on the abutment 30 of the cover 26 as shown in FIG. 14. Accordingly, the main body 25 and the cover 26 are connected with each other in such a manner the annular projection 42 of the cover 26 is engaged with the annular groove 41 of the main body 25.

Figure 15:
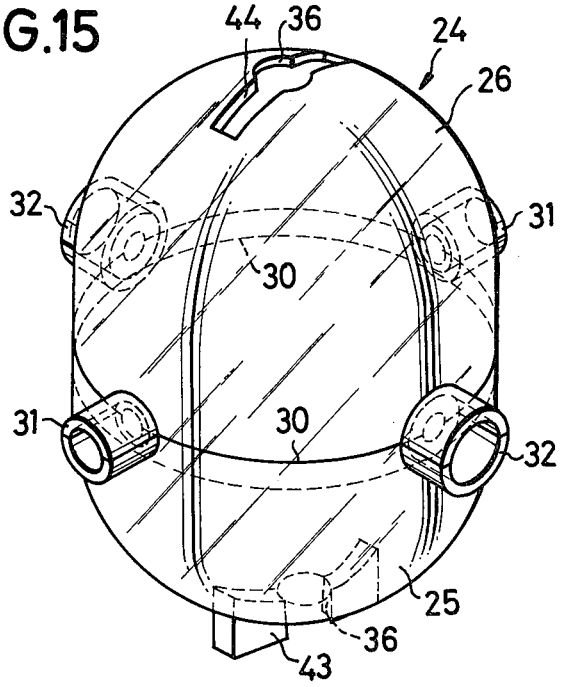
FIG. 15 is a perspective view of a capsule according to the sixth embodiment of this invention.

Next, the sixth embodiment of this invention will be described in reference to FIG. 15. In this embodiment, further modifications are added to the capsule 24 according to the third embodiment of this invention.

That is, instead of the small holes 35, a ridge 43 is defined at the bottom of the main body 25, and a slit 44 is defined at the top of the cover 26. Further, the ridge 43 and the slit 44 have central holes 36. Accordingly, the capsules 24 can be connected with each other upward and downward by the engagement of the ridge 43 with the slit 44. Still more, the capsule 24 according to this embodiment can be used as a saving box or an egg stand as in the case of the capsule 4 according to the first embodiment of this invention.

While there have been discribed preferred embodiments of this invention, obviously modifications and variations are possible in light of the above teachings. It is therefore to be understood that within the scope of appended claims, the invention may be practiced otherwise than as specifically described.

For instance, the cylindrical projections 31 and 32 of the capsule 24 according to the third embodiment of this invention may be formed in the same size each other, and in this case the cylindrical joint can be used to connect the capsules 24 with each other in the lateral direction. Still more, the cross section of the cylindrical projections 31 and 32 may be polygonal.

What is claimed is:

1. A capsule for containing a commodity, sold by a slot machine, comprising:

(A) a main body defining a holding portion for holding a commodity;

(B) a cover member for covering an opening of said holding portion, said cover member being removable from said main body;

(C) cooperating closure means formed integrally at respective edges of said main body and said cover member for enclosing said holding portion of said main body by said cover member to prevent said commodity from dropping out of said holding portion through said openings; and (D) independent combining means for connecting said main body with said cover member in such a condition that the opening of said holding portion is exposed and not covered with said cover member, said combining means also being adapted to connect a plurality of said capsules with each other in such a condition that the opening of said holding portion is covered with said cover member by means of said closure means, said combining means comprising an oblong opening and a ridge dimensioned to be received by said opening, said capsule being usable as a container for coins when said opening of said holding portion is enclosed with said cover member by said closure means, said oblong opening permitting the insertion of coins into said holding portion, said ridge being formed on the bottom of said main body, and said oblong opening is defined by said cover member, said capsule being usable as an egg stand when said ridge is received in said oblong opening, said holding portion of said main body serving to hold an egg and said cover member comprising a base for said main body.

2. A capsule for containing a commodity, sold by a slot machine, comprising:

(A) a main body defining a holding portion for holding a commodity;

(B) a cover member for covering an opening of said holding portion, said cover member being removable from said main body;

(C) cooperating closure means formed integrally at respective edges of said main body and said cover member for enclosing said holding portion of said main body by said cover member to prevent said commodity from dropping out of said holding portion through said openings; and (D) independent combining means adapted to connect a plurality of said capsules with each other in such a condition that the opening of said holding portion is covered with said cover member by means of said closure means, said combining means comprising at least one pair of cylindrical projections formed integrally with and projecting outwardly from said capsule, each pair of cylindrical projections comprising a larger cylindrical member and a smaller cylindrical member, the inner diameter of said larger cylindrical member being substantially equal to the outer diameter of said smaller cylindrical member, said cylindrical projections being formed in part by said main body and in part by said cover member, the projections being developed when the cover member encloses said holding portion of said main body, and additional combining means for connecting said main body with said cover member in such a condition that the opening of said holding portion is exposed and not covered with said cover member.

3. A capsule according to claim 2 wherein said additional combining means comprise a plurality of small holes, and a joining stem having a plurality of pins projecting from its end surfaces, said pins being receivable by said small holes.

4. A capsule according to claim 3 in which said additional combining means are formed on upper and lower portions of said capsule and said independent combining means are formed on side portions of said capsule.

* * * * *